United States Patent [19]

Schmidt et al.

[11] Patent Number: 5,038,447

[45] Date of Patent: Aug. 13, 1991

[54] METHOD FOR PRODUCING SILK FELT AND COMPOSITION FOR CARRYING OUT THE METHOD

[76] Inventors: Traute Schmidt, Rainhalde 29, 7070 Schwäbisch Gemünd; Waltraud Kurz, Fasanenweg 12-14, 8011 Vaterstetten, both of Fed. Rep. of Germany

[21] Appl. No.: 547,864

[22] Filed: Jul. 2, 1990

Related U.S. Application Data

[62] Division of Ser. No. 347,364, May 4, 1989.

[30] Foreign Application Priority Data

May 4, 1988 [DE] Fed. Rep. of Germany ..... 3815179

[51] Int. Cl.[5] ..... D04H 5/02

[52] U.S. Cl. ..... 28/112; 428/282

[58] Field of Search ..... 28/112; 428/280, 282, 428/284, 299

[56] References Cited

U.S. PATENT DOCUMENTS 3,452,413 7/1969 Deitrich ..... 28/112

*Primary Examiner*—Werner H. Schroeder
*Assistant Examiner*—John J. Calvert
*Attorney, Agent, or Firm*—Robert W. Becker & Associates

[57] ABSTRACT

A silk felt that comprises an intermediate layer of natural hair and covering layers of silk wadding or oblong. Furthermore, a method for making this silk felt in which an intermediate layer of natural hair is felted together with two covering layers of silk wadding. The textile material according to the invention is distinguished by a high heat and moisture regulation and by low weight.

6 Claims, 1 Drawing Sheet

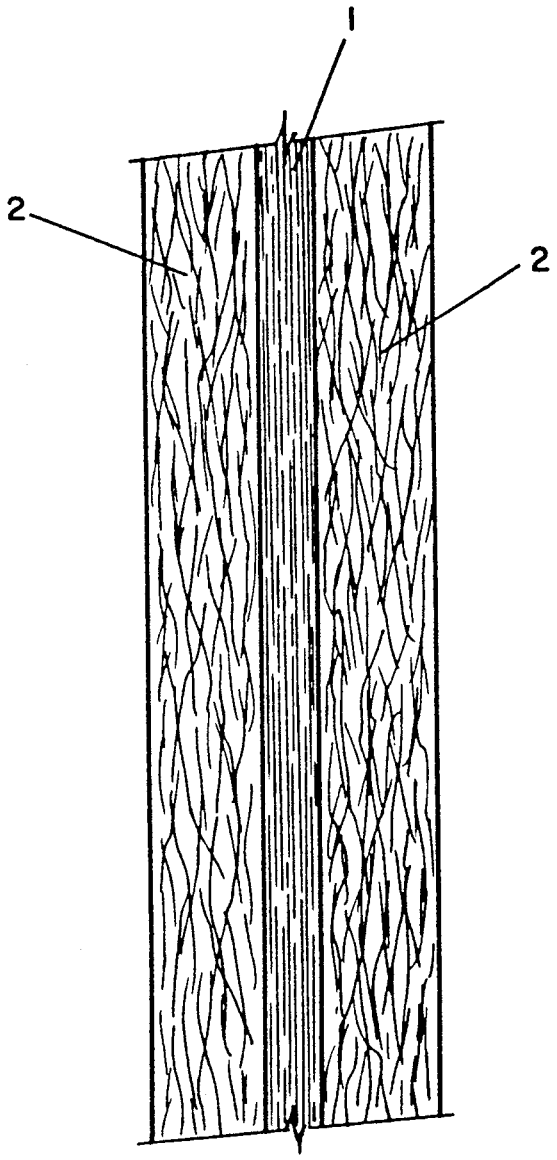
1
2
2

METHOD FOR PRODUCING SILK FELT AND COMPOSITION FOR CARRYING OUT THE METHOD

This application is a division of Ser. No. 347,364 filed May 4, 1989, now abandoned.

BACKGROUND OF THE INVENTION

The present invention relates to a textile material on the basis of silk in which the silk is present in the felted state.

It was previously not possible to felt silk because in contrast to natural wool or natural hair, the silk filament has a smooth surface.

The felting treatment that is customary with textile materials on a natural hair basis is based on the fact that the rough wool hairs become mutually caught up and linked together. Of course, such a treatment is not possible with the smooth silk thread.

Natural silk is considered to be a very high quality textile raw material, and in particular recently has been finding increasing attention because silk is formed from pure natural fiber and has valuable properties, such as low weight, good heat and moisture regulation, is kind to the skin, etc.

Textile felt materials have, among others, the advantage that they do not have any regular thread course which has to be taken into account during the processing. Furthermore, due to their fluffy nature, such textile materials are relatively favorable as regards heat and moisture regulation.

It is an object of the present invention to provide a textile material in which the aforementioned favorable properties of silk are combined with the advantageous structure and the resulting properties of a felt.

BRIEF DESCRIPTION OF THE DRAWING

This object, and other objects and advantages of the present invention, will appear more clearly from the following specification in conjunction with the accompanying schematic drawing, which is a cross-sectional view through one exemplary embodiment of an inventive sandwich-like silk felt.

SUMMARY OF THE INVENTION

The silk felt of the present invention comprises an intermediate layer of natural hair, and two covering layers of silk wadding.

The wool thus represents only an aid that serves to hold the silk filaments together by catching and linking in the felt. The wool component is kept as small as possible, higher wool components being necessary to ensure a higher resistance to tearing, since they contribute to a more intensive tying of the silk filaments.

The aforementioned sandwich-like silk felt can also be superimposed several times, i.e. it then comprises a plurality of intermediate layers of natural hair and a corresponding number of covering layers of silk wadding.

The intermediate layer of natural hair consists preferably of unspun wool, in particular sliver or carded wool. The weight proportion of the natural hair, depending on the quality and type and thickness of the natural felt, is 3 to 30% by weight, in particular 10 to 25% by weight. More especially, when using high-quality cashmere wool as an auxiliary agent, the foreign proportion can be reduced to about 5% or less. Usually, the tendency is to keep the wool portion as small as possible because the wool filaments serve only as binding means for holding the silk felt together.

The inventive method of making the aforementioned silk felt material is characterized primarily in that an intermediate layer of natural hair is felted together with two covering layers of silk wadding.

Preferably, the method according to the present invention is carried out by:

(a) making a laminate material of a thin intermediate layer of unspun natural hair and two covering layers of uniform nonwoven material of silk wadding, (b) impregnating the laminate material with an impregnating liquid containing soft soap, wool fat, and an emulsifier, (c) felting the impregnated laminate material between finely napped foils by random stroking movements under slight pressure, (d) rolling up the laminate material together with the foils and expelling the impregnating liquid outwardly under uniform stroking out, (e) subjecting the roll to a kneading and stroking treatment, (f) uncoiling the roll, rolling the laminate material obtained into a coarsely napped foil, and subjecting it to a further felting operation according to steps (d) and (e), and (g) uncoiling the roll, wrapping the laminate material obtained into an absorbent cloth, tying the roll obtained at uniform intervals, and then rinsing and spinning it in a washing machine.

BRIEF DESCRIPTION OF THE DRAWINGS

FIG. 1 is a cross-sectional view of the layers of fibers according to the method.

FIG. 2 is a flow chart of the method.

DESCRIPTION OF PREFERRED EMBODIMENTS

Referring now to the drawing in detail, which shows a cross-section through a sandwich-like silk felt or fulling material according to the invention, the intermediate layer of natural hair is indicated by the reference numeral 1, and the covering layers of silk wadding are indicated by the reference numerals 2.

As silk material for the covering layer, preferably silk wadding (oblong), flock silk, or sliver is employed, for example from the mulberry silkworm, the giant or wild silkworm, or other silkworms.

As natural hair for the intermediate layer, preferably unspun wool is used, for example yak wool, cashmere, camel hair wool, alpaca wool, or simple sheep wool. Mohair wool (from the angora goat) is not suitable because of the smooth nature of its fibers.

The essence of the method according to the invention resides in that the filaments of the silk wadding or oblong, which themselves cannot be felted, are caught up in the felting operation by the scaling structure of the wool and get caught therein. The more intensive the pressing movements, the greater the tangling.

As impregnating liquid, preferably an aqueous mixture is used containing soft soap, wool fat (lanolin), and an emulsifier. The impregnating liquid preferably contains 10 to 100 g soft soap, 1 to 20 g wool fat, and 1 to 20 g emulsifying cetylstearyl alcohol per 1 liter water. Cetylstearyl alcohol has proved to be particularly suitable as an emulsifier. Preferably, the impregnating liquid is made by dissolving soft soap in hot water and then mixing a mixture of wool fat and emulsifier therein. The water is preferably soft water, i.e. has a relatively low calcium content. For example, boiled water or deionized water may be employed. Before use, the impregnating solution must be cooled to 60 C. or below, the temperature depending on how the wool withstands heat.

It is particularly expedient to prepare, for making the impregnating liquid, a premixture of equal parts by weight wool fat and emulsifying cetylstearyl alcohol. Preferably, 50–300 g each of wool fat and emulsifying cetylstearyl alcohol is mixed with 1 liter water. For making the impregnating liquid, preferably about 1 tablespoon of this premixture (lotion) together with about 2 tablespoons of soft soap are added to 1 liter water and, to ensure an optimum dissolving of the soft soap, are briefly boiled.

Hereinafter, a preferred embodiment of the method according to the invention for making a thin felt will be described in detail, using cashmere wool as an intermediate layer. Of course, felts can also be made using other types of wool, the material thicknesses being varied in accordance with the materials used and the desired properties.

First, a support with fine naps is prepared as a working surface. Suitable for this purpose is, for example, an air cushion nap or burl foil or sheet as is known for packaging purposes. The nap or knob diameter is about 8 mm. Silk wadding (oblong) unravelled to a thin fleece is placed on the fine nap foil. It should be ensured that the fleece has a thickness which is as uniform as possible, with no pockets being present. The unspun cashmere wool is then unravelled to small thin tufts and is placed in a scale-like or rooftile-like manner on the silk fleece. The wool covering should be uniform and should cover the entire area because the wool establishes the binding of the silk filaments. A layer of unravelled silk fleece is again placed on the woo intermediate layer. The wool proportion approximately is 5% of the total laminate material.

Possibly, one or more further wool layers and a corresponding number of further covering layers of silk fleece may be applied.

An impregnating liquid which has been made by mixing about 40 g soft soap, about 5 g lanolin, and about 5 g emulsifying cetylstearyl alcohol with 1 liter hot boiled water is sprayed at a temperature of at the most 60 C. onto the laminate material to ensure saturated impregnation of the laminate material. Under light pressing movements, the air is slowly pressed out of the fabric. The pressed felt material saturated with solution is subjected under slight pressure to irregular stroking movements, the stroking movements initially being made from the center of the surface to the edges and thereafter crisscross and also in circles. To permit the fibers to slide into each other, the pressure exerted should not be too high. The fibers should execute a sort of swimming movement. During the stroking treatment, the wool and silk filaments slide into each other and the fibers enter a sort of chain link with each other (zip fastener principle). The impregnating liquid serves in particular as a lubricant. Due to the different surface structure (silk smooth, wool rough) and due to the rubbing and massaging movements performed, which are supported by the nap or knob-like support, the silk filaments are caught up and linked by the wool with its scaly structure. The more intensively the "silk massage" is carried out, the greater is the entangling.

Thereafter the already somewhat bonded felt material is turned over and the same operation is carried out from the other side. Since the material must always be impregnated with the impregnating solution, further liquid may possibly have to be poured over.

To complete this operation, a further fine-napped foil is placed thereon and the stroking movements are repeated.

Finally, the resulting felt is rolled up between the foils, with uniform stroking out being provided to expel the liquid. The roll is then alternately kneaded and stroked. This provides further consolidation of the bonding between the silk and wool fibers.

A further increase in the stability can be achieved by placing the felt treated in the aforementioned manner onto a coarsely napped foil (nap or knob diameter up to 20 mm), coiling up, and again subjecting to the aforementioned kneading and stroking treatment.

Finally, the impregnating liquid is removed from the felt obtained. For this purpose, the felt is preferably wrapped up in an absorbent textile material and is subjected to a rinsing treatment (preferably at normal temperature) in a washing machine. This further intensifies the felting process. Finally, the roll is spun dry. For this, it is preferably tied up in small sections to avoid the formation of bulbs or knots during the spinning by displacement.

After unwrapping, the silk felt material is dried in air. The felt may be dyed in any desired manner like normal silk fabric. It is possible to carry out a dyeing during the impregnating operation itself by adding batik or silk dye to the impregnating solution.

An advantage of the silk felt resides in that in contrast to usual fabric, no account need be taken of the thread path. It is possible to make up the cuts in a puzzle manner. The felt can be punched. Extensive use even of very small waste parts is possible.

A silk felt is distinguished by an extremely high temperature regulation. Furthermore, it has high moisture absorption without feeling wet. Finally, the extremely low weight of the textile material according to the invention is remarkable.

The silk felt according to the invention is suitable, for example, for making jackets, coats, mattress overlays, blankets (because of the low weight and optimum temperature regulation in particular for rheumatism and gout patients), shoes, gloves, insert soles, protective covers, lining materials (in particular for winter clothing), and hats.

The present invention is, of course, in no way restricted to the specific disclosure of the specification and drawing, but also encompasses any modifications within the scope of the appended claims.

WHAT WE CLAIM IS:

1. A method of making a silk felt, which includes the step of felting together an intermediate layer of natural hair with two covering layers of silk wadding using an impregnating liquid.

2. A method according to claim 1, which includes the steps of:

(a) making a laminate material of a thin intermediate layer of unspun natural hair and two covering layers of uniform nonwoven material of silk wadding, (b) impregnating the laminate material with said impregnating liquid containing soft soap, wool fat, and an emulsifier, (c) felting the impregnated laminate material between finely napped foils by random stroking movements under slight pressure, (d) rolling up the laminate material together with the foils and expelling the impregnating liquid outwardly under uniform stroking out, (e) subjecting the roll to a kneading and stroking treatment, (f) uncoiling the roll, rolling the laminate material obtained into a coarsely napped foil, and subjecting it to a further felting operation according to steps (d) and (e), and (g) uncoiling the roll, wrapping the laminate material obtained into an absorbent cloth, tying the roll obtained at uniform intervals, and then rinsing and spinning it in a washing machine.

3. A method according to claim 2, which includes the step of using emulsifying cetylstearyl alcohol as said emulsifier.

4. A method according to claim 2, which includes the step of using impregnating liquid that per 1 liter water contains 10 to 100 g soft soap, 1 to 20 g wool fat, and 1 to 20 g emulsifying cetylstearyl alcohol.

5. A method according to claim 4, which includes the step of applying said impregnating liquid to said laminate material at a temperature of 50 to 60 C.

6. A according to claim 1, wherein the impregnating liquid is a composition containing wool fat and emulsifying cetylstearyl alcohol.

* * * * *